US008944862B2

(12) United States Patent
Sato

(10) Patent No.: US 8,944,862 B2
(45) Date of Patent: Feb. 3, 2015

(54) STRUCTURE OF CONNECTION OF CRIMPING TERMINAL TO ELECTRIC WIRE

(75) Inventor: Kei Sato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 169 days.

(21) Appl. No.: 13/583,772

(22) PCT Filed: Mar. 23, 2011

(86) PCT No.: PCT/JP2011/056975
§ 371 (c)(1),
(2), (4) Date: Sep. 10, 2012

(87) PCT Pub. No.: WO2011/118628
PCT Pub. Date: Sep. 29, 2011

(65) Prior Publication Data

US 2013/0005197 A1 Jan. 3, 2013

(30) Foreign Application Priority Data

Mar. 23, 2010 (JP) ..... 2010-066856

(51) Int. Cl.
*H01R 4/10* (2006.01)

(52) U.S. Cl.
USPC ..... 439/877; 439/878

(58) Field of Classification Search
USPC ..... 439/877, 878
See application file for complete search history.

(56) References Cited

U.S. PATENT DOCUMENTS

| | | | | |
|---|---|---|---|---|
| 5,408,743 | A * | 4/1995 | Tournier et al. | 29/863 |
| 5,882,233 | A * | 3/1999 | Idehara | 439/877 |
| 6,951,491 | B2 * | 10/2005 | Sakaguchi et al. | 439/879 |
| 8,000,803 | B2 * | 8/2011 | Araujo | 607/116 |
| 2001/0039153 | A1 | 11/2001 | Suzuki | |

FOREIGN PATENT DOCUMENTS

CN 1323081 A 11/2001

(Continued)

OTHER PUBLICATIONS

Office Action dated Jan. 30, 2014 issued by the Japanese Patent Office in counterpart Japanese Patent Application No. 2010066856.
International Search Report (PCT/ISA/210) dated May 24, 2011, issued by the International Searching Authority in International Application No. PCT/JP2011/056975.

(Continued)

*Primary Examiner* — Hien Vu
(74) *Attorney, Agent, or Firm* — Sughrue Mion, PLLC

(57) ABSTRACT

A crimping terminal (10) in which an electric wire connection part (12) is formed in substantially a U shape in cross-section view by having base plate parts (21, 23) and pairs of electric wire crimping pieces (22, 24) is used, and a metallic cap (30) having a tubular peripheral wall in which one end of a longitudinal direction is closed and the other end is opened is attached to a conductor (Wa) exposed by removing a portion of an insulating coating of the distal end of an electric wire W, and an opening end of the cap (30) is inserted into a gap between the conductor (Wa) and an insulating coating (Wb) of the electric wire W and is overlapped with an end of the insulating coating (Wb), and a part (24) of the electric wire crimping pieces is crimped to its overlapped portion (lapped portion) (35).

5 Claims, 7 Drawing Sheets

(56) References Cited

FOREIGN PATENT DOCUMENTS

| | | | |
|---|---|---|---|
| JP | 50-27591 | | 8/1975 |
| JP | 55-17231 | | 2/1980 |
| JP | 2000-268924 | A | 9/2000 |
| JP | 2004-207172 | A | 7/2004 |
| JP | 2007-311369 | A | 11/2007 |
| JP | 2008-123914 | A | 5/2008 |
| JP | 2009301943 | A | 12/2009 |

OTHER PUBLICATIONS

Written Opinion (PCT/ISA/237) dated May 24, 2011, issued by the International Searching Authority, in International Application No. PCT/JP2011/056975.

Office Action dated Jul. 3, 2014 issued by the State Intellectual Property Office of the People's Republic of China in counterpart Chinese Patent Application No. 201180015584.4.

* cited by examiner

STRUCTURE OF CONNECTION OF CRIMPING TERMINAL TO ELECTRIC WIRE

TECHNICAL FIELD

The present invention relates to a structure of connection of a crimping terminal to an electric wire.

BACKGROUND ART

FIGS. 8(*a*) to 8(*c*) show a structure of connection between a terminal and an electric wire described in Patent Reference 1.

As shown in FIGS. 8(*a*) and 8(*b*, in this structure of connection between the terminal and the electric wire, a metallic cap 230 with the size in which the range from a conductor (mainly including a twisted wire obtained by twisting many strands together) Wa exposed by removing an insulating coating Wb to the portion having the insulating coating Wb is covered is first attached to the distal end of an electric wire W, and the insertion portion of the conductor Wa of the distal end of the electric wire W to which the cap 230 is attached is placed on a base plate part 221 of an electric wire connection part 212 formed in the back of a terminal 210. In that state, as shown in FIG. 8(*c*), a pair of conductor crimping pieces 222 upwardly extending in both lateral edges of the base plate part 221 is crimped and fixed so as to obtain a state in which the conductor Wa and the cap 230 make close contact with an upper surface of the base plate part 221 by inwardly bending the conductor crimping pieces 222 so as to wrap the conductor Wa and the cap 230.

In the cap 230, a portion 231 into which the outer periphery of the conductor Wa is fitted is formed in a tube shape with a small diameter, and an inlet side portion 232 into which the outer periphery of the insulating coating Wb is fitted is formed in a tube shape with a large diameter, and a gap between the conductor Wa and the cap 230 is filled with a waterproof filler (not shown). Also, an inner peripheral surface of the electric wire connection part 212 of the terminal 210 is provided with serrations 228 for increasing contact continuity between the cap 230 and the terminal 210.

The reason why the cap 230 is used herein is because electrolytic corrosion may occur when water adheres to a part of contact between different kinds of metals (that is, a press bond part) in the case where, for example, the conductor Wa of the electric wire W is made of aluminum or aluminum alloy and the terminal 210 is made of copper or copper alloy, and a material of the cap 230 is set in the same kind (copper or copper alloy) as a material of the terminal 210 in order to prevent such electrolytic corrosion from occurring. Also, a terminal made of aluminum or aluminum alloy can be used for an aluminum electric wire, but both of the terminal 210 and the cap 230 are made of copper or copper alloy for the reason why the terminal made of copper or copper alloy has an advantage over the terminal made of aluminum or aluminum alloy in strength. When the materials are selected thus, the cap 230 is made of metal different from that of the conductor Wa of the electric wire W (the former is made of copper or copper alloy and the latter is made of aluminum or aluminum alloy), but a gap between the conductor Wa and the cap 230 is filled with a filler (not shown), and water is prevented from entering the inside of the cap 230 and there is no fear of electrolytic corrosion.

PRIOR ART REFERENCE

Patent Reference

Patent Reference 1: JP-A-2004-207172

DISCLOSURE OF THE INVENTION

Problems that the Invention is to Solve

Incidentally, in the conventional structure of connection between the terminal and the electric wire described above, water is prevented from entering the inside of the cap 230 by filling the gap between the cap 230 and the conductor Wa of the electric wire W with the filler, but the filler is used, so that there was a problem that a control item at the time of actual use increased and it was not practical.

The invention has been implemented in view of the circumstances described above, and an object of the invention is to provide a structure of connection of a crimping terminal to an electric wire capable of preventing water from entering the inside of a cap without using a filler and thereby decreasing a control item at the time of actual use to improve practicality.

Means for Solving the Problems

In order to achieve the object described above, a structure of connection of a crimping terminal to an electric wire according to the invention is characterized by the following (1) to (4).

(1) A structure of connection of a crimping terminal to an electric wire, the crimping terminal having an electrical connection part for making connection to the other terminal in the front, and an electric wire connection part formed in substantially a U shape in cross-section view by having a base plate part, and a pair of electric wire crimping pieces which upwardly extends from both lateral edges of the base plate part and is crimped so as to obtain a state in which a distal end of the electric wire is brought into close contact with an upper surface of the base plate part by inwardly bending the electric wire crimping pieces so as to wrap the distal end of the electric wire to be connected in the back of the electrical connection part, wherein a metallic cap having a tubular peripheral wall in which one end of a longitudinal direction is closed and the other end is opened is attached to a conductor exposed by removing a portion of an insulating coating of the distal end of the electric wire, and an opening end of the cap is inserted into a gap between the conductor and the insulating coating of the electric wire and is overlapped with an end of the insulating coating, and the cap is surrounded by crimping the electric wire crimping pieces so as to crimp a part of the electric wire crimping pieces to its overlapped portion.

(2) In the structure of connection of the crimping terminal to the electric wire with the configuration of the above (1), an outer peripheral side corner of an opening end of the cap is chamfered.

(3) In the structure of connection of the crimping terminal to the electric wire with the configuration of the above (1) or (2), an opening end of the cap is cut in an inclined surface inclined to a central axis line of the cap and a part of a circumferential direction of a tubular peripheral wall of the cap is projected more than the other part of the circumferential direction.

(4) In the structure of connection of the crimping terminal to the electric wire with the configuration of any one of the above (1) to (3), a tubular peripheral wall in an opening end side of the cap is provided with a projection.

According to the structure of connection of the crimping terminal to the electric wire with the configuration of the above (1), the opening end of the cap is inserted into the gap between the conductor and the insulating coating and is overlapped with the end of the insulating coating and a part of the electric wire crimping pieces is crimped to its overlapped portion, so that a path for causing water to enter the inside of the cap from the outside can be formed in a labyrinthine path narrowed and folded complexly. As a result, entrance of the water to the inside of the cap can surely be blocked without being filled with a filler like a conventional example.

According to the structure of connection of the crimping terminal to the electric wire with the configuration of the above (2), the opening end of the cap can be inserted into the gap between the conductor and the coating easily, and attachment workability of the cap can be improved.

According to the structure of connection of the crimping terminal to the electric wire with the configuration of the above (3), a part of the circumferential direction of the tubular peripheral wall of the cap is projected more than the other part of the circumferential direction by obliquely cutting the opening end of the cap in the inclined surface, so that while the conductor of the distal end of the electric wire is placed on the projected part of the tubular peripheral wall and its projected part is used as a guide, the conductor of the electric wire can easily be inserted into the inside of the cap.

According to the structure of connection of the crimping terminal to the electric wire with the configuration of the above (4), in the case of inserting the opening end of the cap into the gap between the conductor and the insulating coating of the electric wire, the projection with which the tubular peripheral wall is provided becomes hooked to the insulating coating, so that the cap becomes resistant to coming out. Therefore, since a path of entrance of water is bent more complexly, the water can more be inhibited from entering.

Advantage of the Invention

According to the invention, the opening end of the cap is inserted into the gap between the conductor and the insulating coating in the portion having the insulating coating of the distal end of the electric wire and is overlapped with the end of the insulating coating and a part of the electric wire crimping pieces is crimped to its overlapped portion, so that a path for causing water to enter the inside of the cap from the outside can be formed in a labyrinthine path narrowed and folded complexly. As a result, entrance of the water to the inside of the cap can surely be blocked without being filled with a filler like a conventional example. Therefore, a control item of the filler at the time of actual use can be decreased to improve practicality.

The invention has been described above briefly. Further, the details of the invention will become more apparent by reading through a mode for carrying out the invention described below with reference to the accompanying drawings.

BRIEF DESCRIPTION OF THE DRAWINGS

FIG. 2 is a perspective view showing a state in which the distal end of the electric wire with the cap of FIG. 1(*c*) attempts to be set in an electric wire connection part of a crimping terminal.

FIG. 4 is a sectional view showing a configuration of a cap of another embodiment used in a structure of connection of the invention.

FIG. 5 is a sectional view showing a configuration of a cap of a further embodiment used in a structure of connection of the invention, and is a sectional view showing a state in which a conductor of the distal end of an electric wire attempts to be inserted into the cap.

FIG. 6 is a sectional view of an improved cap of the embodiment of FIG. 5.

MODE FOR CARRYING OUT THE INVENTION

An embodiment of the invention will hereinafter be described with reference to the drawings.

In addition, in the invention, the side connected to the other terminal etc. in a crimping terminal is set at the front, and the side connected to an electric wire in the crimping terminal is set at the back.

Figure 1A:
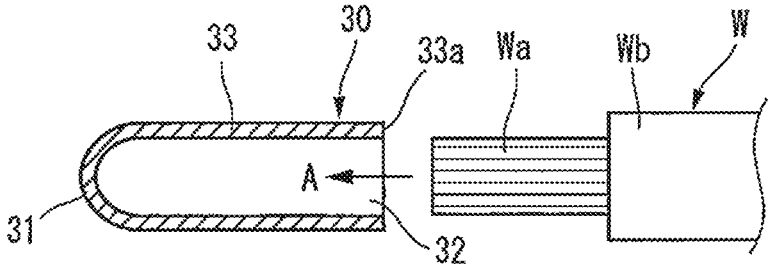
[FIG. 1] FIGS. 1(*a*) to 1(*c*) are explanatory diagrams of an embodiment of the invention, and FIG. 1(*a*) is a sectional view showing a state in which a conductor of the distal end of an electric wire attempts to be inserted into a cap used in a structure of connection of the embodiment, and FIG. 1(*b*) is a sectional view showing a state in which the conductor of the electric wire is inserted into the cap to a position in which an opening end of the cap abuts on the end of an insulating coating, and FIG. 1(*c*) is a sectional view showing a state in which the conductor is inserted to a predetermined position of the inside of the cap while inserting the opening end of the cap into a gap between the conductor and the insulating coating of the electric wire.
Figure 1B:
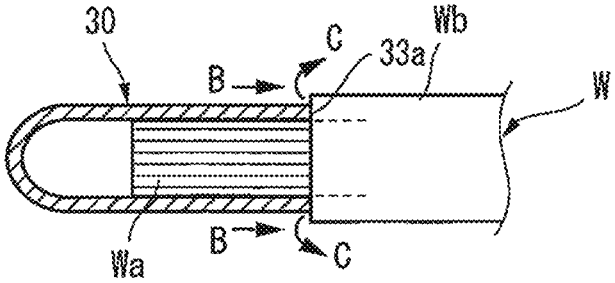
Figure 1C:
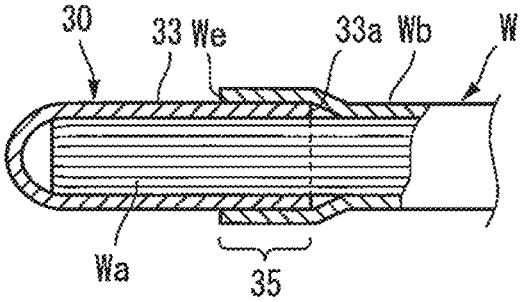
Figure 2:
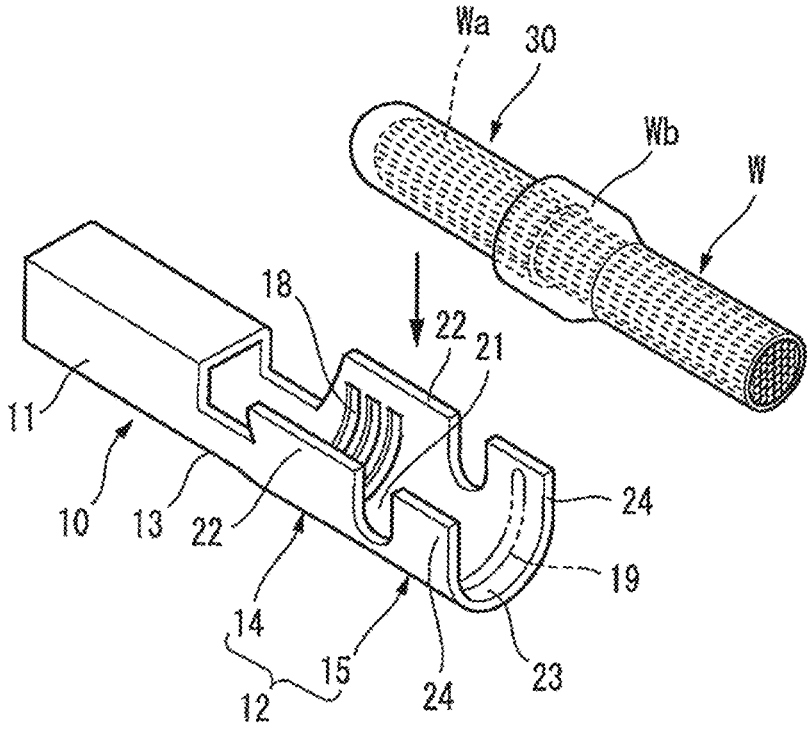
[FIG. 2]
Figure 3A:
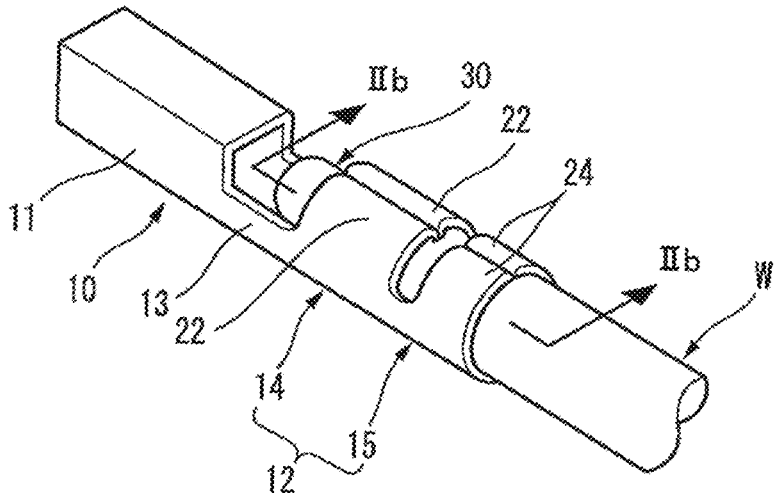
[FIG. 3] FIGS. 3(*a*) and 3(*b*) are configuration diagrams of the structure of connection of the embodiment completed by crimping conductor crimping pieces and coating crimping pieces of the electric wire connection part after the distal end of the electric wire with the cap is set in the electric wire connection part of the crimping terminal, and FIG. 3(*a*) is an outline perspective view, and FIG. 3(*b*) is a sectional view taken on arrow IIb-IIb of FIG. 3(*a*).
Figure 3B:
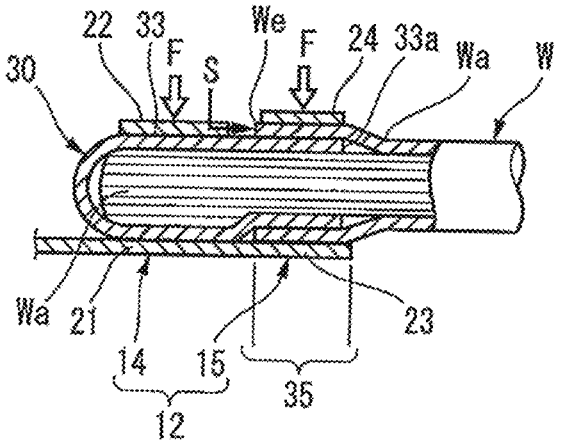

FIG. 1 is an explanatory diagram of the embodiment, and FIG. 1(*a*) is a sectional view showing a state in which a conductor of the distal end of an electric wire attempts to be inserted into a cap used in a structure of connection of the embodiment, and FIG. 1(*b*) is a sectional view showing a state in which the conductor of the electric wire is inserted into the cap to a position in which an opening end of the cap abuts on the end of an insulating coating, and FIG. 1(*c*) is a sectional view showing a state in which the conductor is inserted to a predetermined position of the inside of the cap while inserting the opening end of the cap into a gap between the conductor and the insulating coating of the electric wire. FIG. 2 is a perspective view showing a state in which the distal end of the electric wire with the cap of FIG. 1(*c*) attempts to be set in an electric wire connection part of the crimping terminal, and FIG. 3 is a configuration diagram of the structure of connection of the embodiment completed by crimping conductor crimping pieces and coating crimping pieces of the electric wire connection part after the distal end of the electric wire with the cap is set in the electric wire connection part of the crimping terminal, and FIG. 3(*a*) is an outline perspective view, and FIG. 3(*b*) is a sectional view taken on arrow IIb-IIb of FIG. 3(*a*).

As shown in FIG. 2, a crimping terminal 10 used herein is a female terminal, and has a box-shaped electrical connection part 11, with a built-in spring piece, for making connection to the other terminal etc. (not shown) in the front, and has an electric wire connection part 12 crimped and connected to the distal end of an electric wire W through a joining part 13 in the back of the electrical connection part 11.

The electric wire connection part 12 includes a conductor press bond part 14 positioned in the front side, and a coating crimp part 15 positioned in the back side of the conductor press bond part 14. The conductor press bond part 14 of the front side is formed in substantially a U shape in cross-section view by having a base plate part 21 and a pair of conductor crimping pieces (electric wire crimping pieces) 22 which upwardly extends from both lateral edges of the base plate part 21 and is crimped so as to obtain a state in which a conductor Wa is brought into close contact with an upper surface of the base plate part 21 by inwardly bending the conductor crimping pieces 22 so as to wrap the conductor Wa exposed by removing an insulating coating (hereinafter also called a coating simply) Wb of the distal end of the electric wire W to be connected. Also, the coating crimp part 15 of the back side is formed in substantially a U shape in cross-section view by having a base plate part 23 and a pair of coating crimping pieces (electric wire crimping pieces) 24 which upwardly extends from both lateral edges of the base plate part 23 and is crimped so as to obtain a state in which the portion having the coating Wb of the distal end of the electric wire W is brought into close contact with an upper surface of the base plate part 23 by inwardly bending the coating crimping pieces 24 so as to wrap the portion having the insulating coating Wb of the distal end of the electric wire W to be connected.

Here, the base plate part 21 of the conductor press bond part 14 and the base plate part 23 of the coating crimp part 15 are continuously formed as a common base plate part. Also, the conductor crimping pieces 22 of the conductor press bond part 14 and the coating crimping pieces 24 of the coating crimp part 15 are formed in the form in which the lower ends are somewhat continuously joined but the upper ends are mutually divided by U-shaped notches put in the boundary between both crimping pieces so as to be able to be crimped respectively independently. Also, an inner peripheral surface of the conductor press bond part 14 is provided with plural serrations (recessed grooves) 18 extending in a direction intersecting with a longitudinal direction of the electric wire W. Further, an inner peripheral surface of the coating crimp part 15 is provided with a serration or a protrusion 19 extending in the direction intersecting with the longitudinal direction of the electric wire W as necessary.

A metallic cap 30 as shown in FIG. 1(*a*) is used for obtaining a structure of connection of the embodiment. This cap 30 is formed of a metal (for example, copper or copper alloy) of the same kind as that of the crimping terminal 10, and also has a tubular peripheral wall 33 in which one end 31 of a longitudinal direction is closed and the other end 32 is opened, and the top of the opening side of the tubular peripheral wall 33 is formed in an opening end 33*a*. The cap 30 has an axial length corresponding to the length ranging from the top of the conductor Wa of the distal end of the electric wire W to the portion having the insulating coating Wb and also, an inside diameter of the cap 30 is set in size capable of just inserting the conductor Wa of the electric wire W. Also, a wall thickness of the tubular peripheral wall 33 is set in thickness of the extent to which the opening end 33*a* can forcibly be inserted into a gap between the conductor Wa and the coating Wb of the electric wire W.

After the conductor Wa with a proper length is exposed to the distal end of the electric wire W by removing the coating Wb, its conductor Wa is inserted into the inside of the metallic cap 30 as shown by arrow A in FIG. 1(*a*), and continues to be inserted to a position in which the opening end 33*a* of the cap 30 abuts on the coating Wb as shown in FIG. 1(*b*). Next, while the cap 30 is pushed into the side having the coating Wb as shown by arrows B in FIG. 1(*b*) and also the end of the coating Wb is peeled as shown by arrows C, the opening end 33*a* of the cap 30 is inserted into the gap between the conductor Wa and the coating Wb in the portion having the coating Wb of the distal end of the electric wire W, and a predetermined length dimension in the opening end side of the cap 30 is overlapped with the end of the coating Wb as shown in FIG. 1(*c*). The length of the overlapped portion (that is, a lapped portion 35) is set in the same dimension as or the dimension slightly larger than a width dimension of the coating crimping piece 24.

Next, as shown in FIG. 1(*c*), the distal end of the electric wire W to which the cap 30 is attached is placed on upper surfaces of the base plate parts 21, 23 of the conductor press bond part 14 and the coating crimp part 15 of the electric wire connection part 12 of the crimping terminal 10 as shown in FIG. 2. Then, each of the conductor crimping pieces 22 of the conductor press bond part 14 and each of the coating crimping pieces 24 of the coating crimp part 15 of the electric wire connection part 12 are inwardly bent and are crimped so as to surround the distal end of the electric wire W through the cap 30 and thereby, the cap 30 and the conductor Wa of the electric wire W are crushed and deformed to obtain a structure of connection of the embodiment in which the crimping terminal 10 is connected to the electric wire Was shown in FIG. 3(*a*). In that case, each of the conductor crimping pieces 22 and each of the coating crimping pieces 24 respectively push the conductor Wa and the coating Wb through the cap 30, for example, by a force F as shown in FIG. 3(*b*), and the coating crimping pieces 24 exert a crimping force on the lapped portion 35 of the coating Wb and the cap 30.

According to the structure of connection of the crimping terminal 10 to the electric wire W configured thus, the opening end 33*a* of the cap 30 is inserted into the gap between the conductor Wa and the coating Wb of the electric wire W and the predetermined length dimension in the opening end side of the cap 30 is overlapped with the end of the coating Wb and the coating crimping pieces 24 are crimped to its overlapped portion (the lapped portion 35), so that an inlet of a path for causing water S to enter the inside of the cap 30 from the outside first results in the end We of the coating Wb. Next, even if the water S enters from its inlet, the water S finally reaches the conductor Wa after reaching the opening end 33*a* of the cap 30 through the lapped portion 35 of the cap 30 and the coating Wb on which the crimping force is exerted from the outside.

Thus, the path for causing the water to enter the conductor Wa from the outside forms a labyrinthine path narrowed and folded complexly. Therefore, it becomes almost impossible for the water to enter actually. That is, entrance of the water S to the inside of the cap 30 can surely be blocked without being filled with a filler like a conventional example, and a control item of the filler at the time of actual use can be decreased to improve practicality.

The invention is not limited to the embodiment described above, and modifications, improvements, etc. can be made properly. Moreover, as long as the invention can be achieved, the number of components, materials, shapes, dimensions, arrangement places, etc. of each component in the embodiment described above are arbitrary and are not limited.

Configurations of caps in other embodiments will hereinafter be described in detail.

Figure 4:
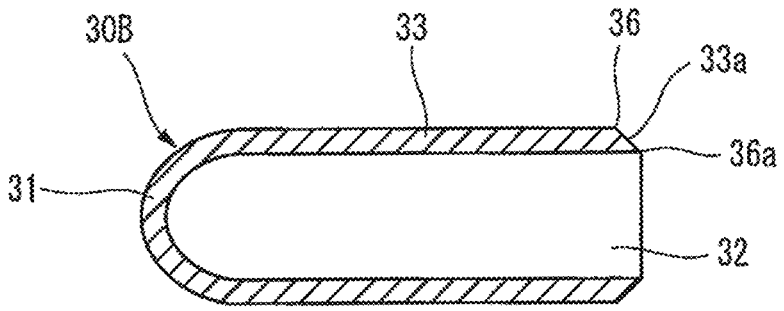
[FIG. 4]

For example, in a cap 30B shown in FIG. 4, an outer peripheral side corner of an opening end 33*a* of a tubular peripheral wall 33 is chamfered. When a chamfered part 36 is formed by giving chamfering corresponding to a wall thickness to the outer peripheral side corner of the opening end 33*a* and an inner peripheral side corner 36*a* is formed at a sharp angle, the opening end 33*a* of the cap 30B can be inserted into a gap between a conductor Wa and a coating Wb of an electric wire W more easily, and attachment workability of the cap 30B can be improved.

Figure 5:
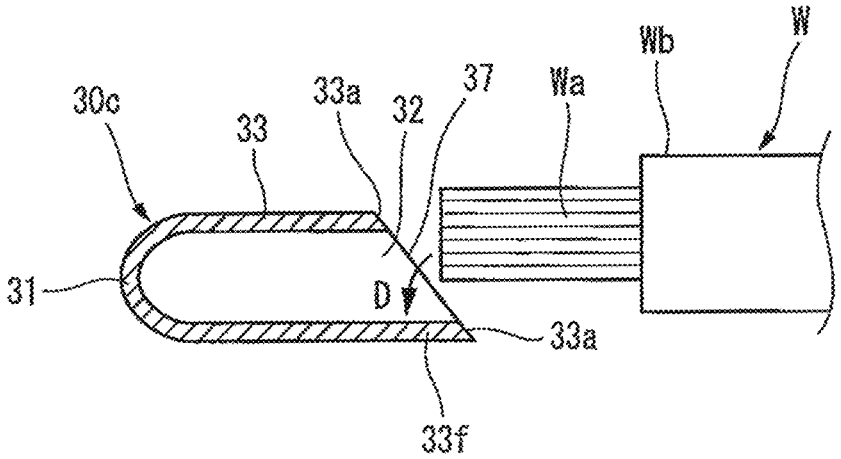
[FIG. 5]

Also, in a cap 30C shown in FIG. 5, a part 33*f* of a circumferential direction of a tubular peripheral wall 33 of the cap 30C is projected more than the other part of the circumferential direction by cutting an opening end 33*a* of the tubular peripheral wall 33 of the cap 30C in an inclined surface 37 inclined to a central axis line of the cap 30. Therefore, while a conductor Wa of the distal end of an electric wire W is placed on the projected part 33*f* of the tubular peripheral wall 33 as shown by arrow D and its projected part is used as a guide, the conductor Wa of the electric wire W can easily be inserted into the inside of the cap 30C.

Figure 6:
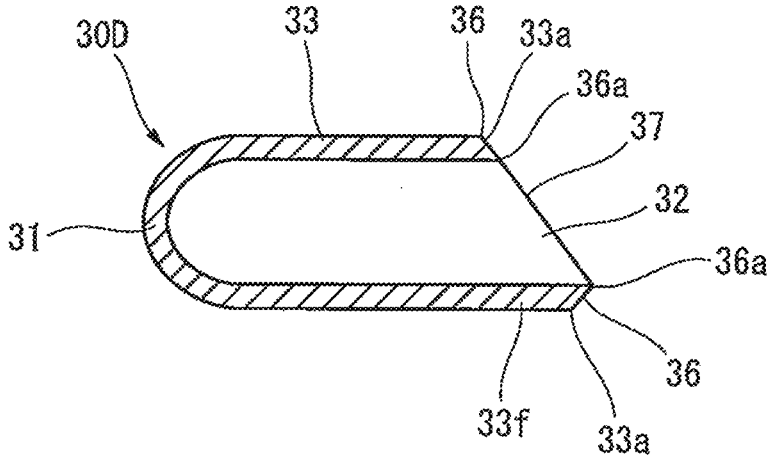
[FIG. 6]

Also in the case of providing a cap with an inclined surface 37, when an outer peripheral side corner of an opening end 33*a* of a tubular peripheral wall 33 is chamfered to form a chamfered part 36 and an inner peripheral side corner 36*a* is formed at a sharp angle as described in a cap 30D shown in FIG. 6, the opening end 33*a* of the cap 30D can be inserted into a gap between a conductor Wa and a coating Wb of an electric wire W more easily.

Figure 7A:
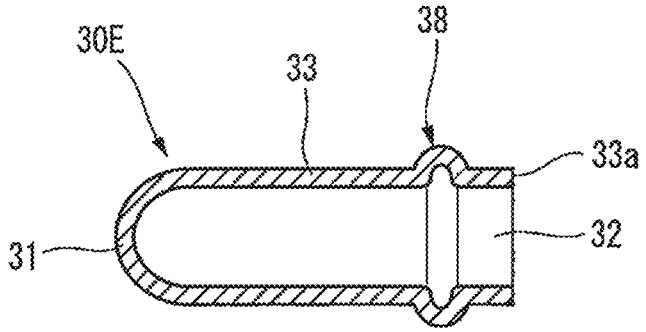
[FIG. 7] FIGS. 7(*a*) and 7(*b*) are sectional views showing a configuration of a cap of a further embodiment used in a structure of connection of the invention, and FIG. 7(*a*) is a sectional view of the cap, and FIG. 7(*b*) is a sectional view showing a state in which a conductor of the distal end of an electric wire is inserted into the inside of the cap and an opening end of the cap is inserted into a gap between the conductor and a coating of the distal end of the electric wire.
Figure 7B:
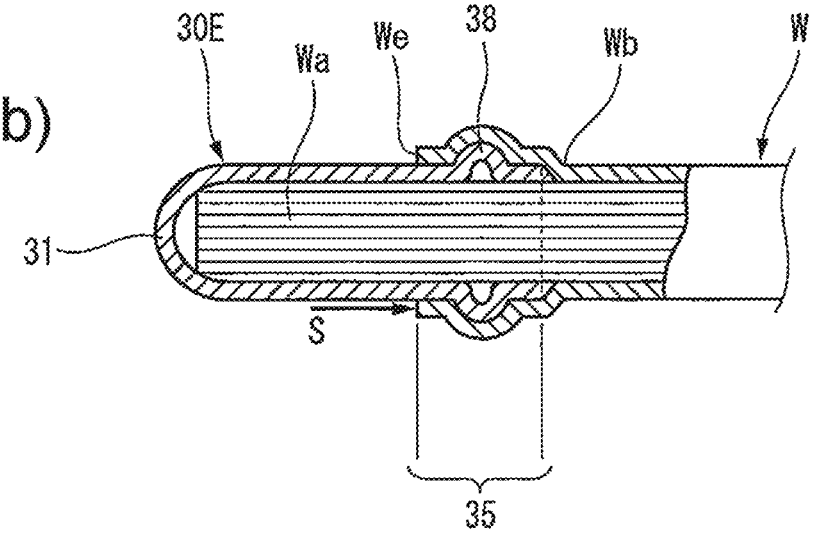
Figure 8A:
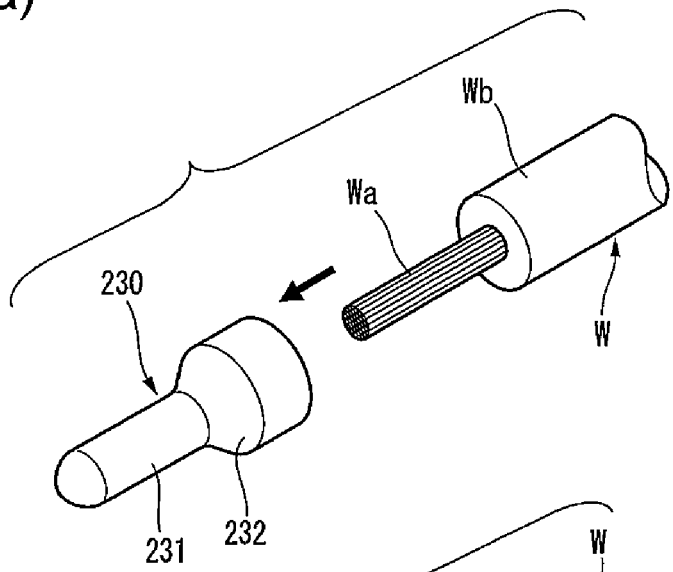
Fig.8(a) PRIOR ART
[FIG. 8] FIGS. 8(*a*) to 8(*c*) are explanatory diagrams of a conventional structure of connection between a terminal and an electric wire, and FIG. 8(*a*) is a perspective view showing a state in which the distal end of the electric wire attempts to be covered with a cap, and FIG. 8(*b*) is a perspective view showing a state in which the distal end of the electric wire covered with the cap attempts to be set in a conductor press bond part of the terminal, and FIG. 8(*c*) is a perspective view showing a state in which conductor crimping pieces of the conductor press bond part are crimped to the distal end of a conductor set in the conductor press bond part and the terminal is connected to the conductor.
Figure 8B:
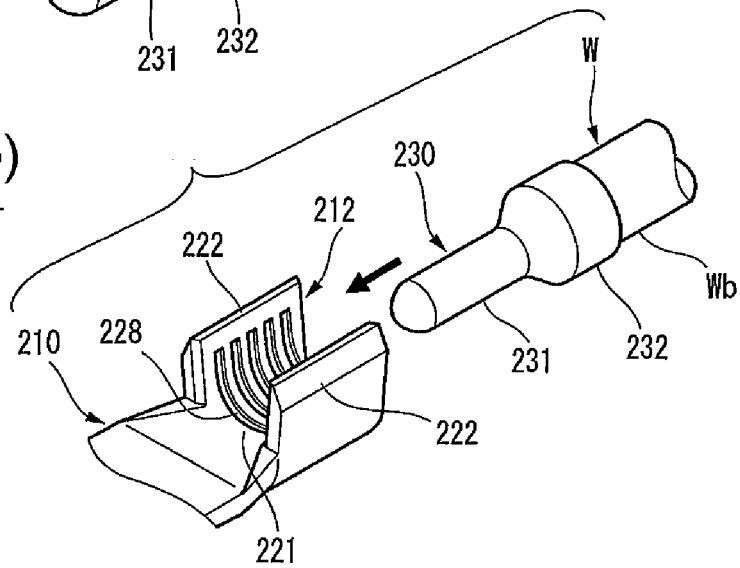
Fig.8(b) PRIOR ART
Figure 8C:
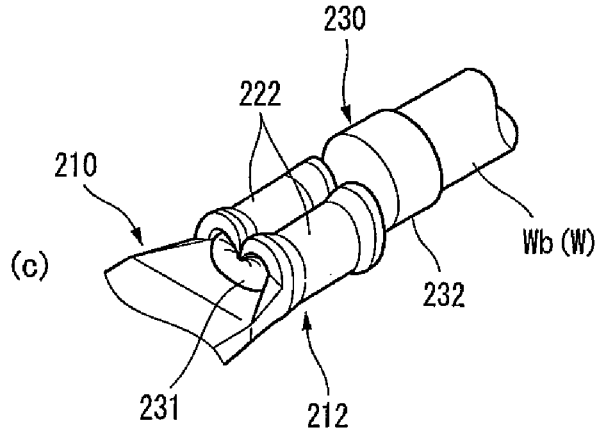
Fig.8(c) PRIOR ART

Also, as described in a cap 30E shown in FIGS. 7(*a*) and 7(*b*), when a projection 38 projected on the outer peripheral side is annularly formed in the vicinity of an opening end 33*a* of a tubular peripheral wall 33 of the cap 30E, the projection 38 becomes hooked to a coating Wb and the cap 30E becomes resistant to coming out in the case of inserting the opening end 33*a* of the cap 30E into a gap between a conductor Wa and the coating Wb of an electric wire W. Also, since a path of entrance of water S is bent more complexly, the water S can more be inhibited from entering. Also in this case, ease of insertion into the gap between the coating Wb and the conductor Wa can be ensured by providing the opening end 33*a* with the chamfered part 36 like the cap 30B of FIG. 4. Also, the opening end 33*a* may be cut in the inclined surface like the cap 30C of FIG. 5.

The invention has been described in detail with reference to the specific embodiments, but it is apparent to those skilled in the art that various changes or modifications can be made without departing from the spirit and scope of the invention. The present application is based on Japanese patent application (patent application No. 2010-066856) filed on Mar. 23, 2010, and the contents of the patent application are hereby incorporated by reference.

DESCRIPTION OF REFERENCE NUMERALS AND SIGNS

W ELECTRIC WIRE
Wa CONDUCTOR
Wb INSULATING COATING
10 CRIMPING TERMINAL
12 ELECTRIC WIRE CONNECTION PART
14 CONDUCTOR PRESS BOND PART
15 COATING CRIMP PART
21 BASE PLATE PART
22 CONDUCTOR CRIMPING PIECE (ELECTRIC WIRE CRIMPING PIECE)
23 BASE PLATE PART
24 COATING CRIMPING PIECE (ELECTRIC WIRE CRIMPING PIECE)
30,30B,30C,33D,33E CAP
31 ONE END
32 THE OTHER END
33 TUBULAR PERIPHERAL WALL
33*a* OPENING END
33*f* PART OF CIRCUMFERENTIAL DIRECTION OF TUBULAR PERIPHERAL WALL (PROJECTED PART)
35 LAPPED PORTION
36 CHAMFERED PART
36*a* INNER PERIPHERAL SIDE CORNER
37 INCLINED SURFACE

The invention claimed is:

1. A structure of connection of a crimping terminal to an electric wire, the crimping terminal comprising:

an electrical connection part formed of a receptacle shaped for making connection to another terminal in front of the crimping terminal; and an electric wire connection part connecting with the electrical connection part and formed in substantially a U shape in cross-section view and having a base plate part, and a pair of electric wire crimping pieces which upwardly extends from both lateral edges of the base plate part and are crimped so as to obtain a state in which a distal end of the electric wire is brought into close contact with an upper surface of the base plate part by inwardly bending the electric wire crimping pieces so as to wrap the distal end of the electric wire to be connected in a back portion of the electrical connection part;

wherein a metallic cap having a tubular peripheral wall in which one end of a longitudinal direction is closed for covering an exposed conductor of the distal end of the electrical wire and the other end is opened is attached to the conductor exposed by removing a portion of an insulating coating of the distal end of the electric wire; and an opening end of the cap is inserted into a gap between the conductor and the insulating coating of the electric wire and is overlapped with an end of the insulating coating to form an overlapped portion, and the cap is surrounded by crimping the electric wire crimping pieces so as to crimp a part of the electric wire crimping pieces to the overlapped portion.

2. The structure of connection of the crimping terminal to the electric wire according to claim 1, wherein an outer peripheral side corner of an opening end of the cap is chamfered.

3. The structure of connection of the crimping terminal to the electric wire according to claim 1, wherein an opening end of the cap is cut in an inclined surface inclined to a central axis line of the cap and a part of a circumferential direction of a tubular peripheral wall of the cap is projected more than the other part of the circumferential direction.

4. The structure of connection of the crimping terminal to the electric wire according to claim 3, wherein a tubular peripheral wall in an opening end side of the cap is provided with a projection.

5. The structure of connection of the crimping terminal to the electric wire according to claim 1, wherein a tubular peripheral wall in an opening end side of the cap is provided with a projection.

* * * * *